US005469645A

United States Patent [19]

Aiken

[11] Patent Number: 5,469,645

[45] Date of Patent: Nov. 28, 1995

[54] SYSTEM FOR RECOVERY OF OIL FROM SNOW AND ICE SURFACES

[75] Inventor: Lewis B. Aiken, Wasilla, Ak.

[73] Assignee: Atlantic Richfield Company, Los Angeles, Calif.

[21] Appl. No.: 229,248

[22] Filed: Apr. 18, 1994

[51] Int. Cl.[6] ..... E01H 4/00; B01D 57/00

[52] U.S. Cl. ..... 37/291; 37/222; 37/227; 210/743; 210/923

[58] Field of Search ..... 37/222, 224, 223, 37/226, 227, 228, 213, 212, 241; 62/66, 212, 533; 210/241, 923, 743

[56] References Cited

U.S. PATENT DOCUMENTS

| | | | |
|---|---|---|---|
| 3,393,462 | 7/1968 | Picker | 37/228 |
| 3,404,470 | 10/1968 | Raiti | 37/228 |
| 3,624,933 | 12/1971 | Faldi | 37/341 X |
| 3,766,586 | 10/1973 | Krickovich | 37/228 X |
| 4,366,052 | 12/1982 | Cloutier | 210/923 X |
| 4,410,426 | 10/1983 | Cloutier | 210/923 X |
| 4,615,129 | 10/1986 | Jackson | 37/228 X |
| 4,839,061 | 6/1989 | Manchak, Jr. et al. | 37/322 X |
| 5,158,679 | 10/1992 | Brock | 210/241 |

*Primary Examiner*—Randolph A. Reese
*Assistant Examiner*—Robert Pezzuto
*Attorney, Agent, or Firm*—Michael E. Martin

[57] ABSTRACT

A land vehicle system for collecting crude oil and other contaminants which have been spilled on snow and ice covered surfaces includes a crawler tractor having an auger type collection and transfer mechanism mounted forwardly thereof for skimming the contaminant and a layer of snow and/or ice from the Earth's surface. The recovered oil and snow and/or ice are transported by a vacuum line to a storage and transport vehicle towed by the tractor. The storage and transport vehicle may be self-propelled and includes an onboard storage tank which is heated to melt the snow and/or ice and a separator for separating air used to transport the contaminated snow and/or ice to the tank. The tractor includes onboard prime movers for operating a vacuum pump for collecting the contaminated snow and/or ice and a prime mover for propulsion and operation of the skimming and collection mechanism.

10 Claims, 3 Drawing Sheets

SYSTEM FOR RECOVERY OF OIL FROM SNOW AND ICE SURFACES

BACKGROUND OF THE INVENTION

1. Field of the Invention

The present invention pertains to a self-propelled land vehicle system for recovery of oil and similar contaminants which have spilled on snow and ice surfaces.

2. Background

The continued development of petroleum reserves located in arctic regions and regions which, at least from time to time, are covered by snow and ice on the earth's surface has brought forth the problem of suitable recovery of crude oil and other contaminants which may be accidentally spilled on snow and ice surfaces. Although several inventions have been developed for recovery of oil spilled in the sea and which has washed ashore, such as evidenced by U.S. Pat. Nos. 5,292,430 to Sullivan, et al and 4,840,729 to Levine, both assigned to the assignee of the present invention, heretofore relatively scant attention has been paid to developing means for recovering oil and similar substances spilled on snow and ice covered surfaces. It is to this end that the present invention has been developed.

SUMMARY OF THE INVENTION

The present invention provides a unique self-propelled land vehicle system for recovering and transporting crude oil and similar contaminants which have been spilled on snow and ice covered surfaces.

In accordance with an important aspect of the present invention, a self-propelled land vehicle system is provided which includes means for gathering oil contaminated snow and ice from the surface of the earth, melting the snow and/or ice and storing the oil and contaminated and melted snow and/or ice for separation at a later time. The vehicle system comprises a tractor and recovery unit operating in conjunction with a storage and transport unit. The tractor unit includes an adjustable auger type recovery apparatus for skimming oil and oil contaminated snow and/or ice from the Earth's surface and a pump for transporting a mixture of recovered oil and snow or ice to the storage and transport unit. The tractor and recovery unit is also advantageously provided with an adjustable auger type recovery and transfer mechanism whose position in proximity to the snow or ice covered surface may be adjusted to recover a sufficient amount of snow or ice covered by oil to substantially remove all oil or similar contaminants from the earth's surface.

Still further, the storage and transport unit advantageously includes means for melting recovered snow or ice to increase the storage capacity thereof. The storage and transport unit is also self-propelled and detachable from the tractor unit to permit independent traversal of the storage and transport unit to a stationary and/or remotely disposed storage and separation system.

The above-noted features and advantages of the invention, together with other important aspects thereof, will be further appreciated by those skilled in the art upon reading the detailed description which follows in conjunction with the drawing.

DESCRIPTION OF PREFERRED EMBODIMENTS

Figure 1:
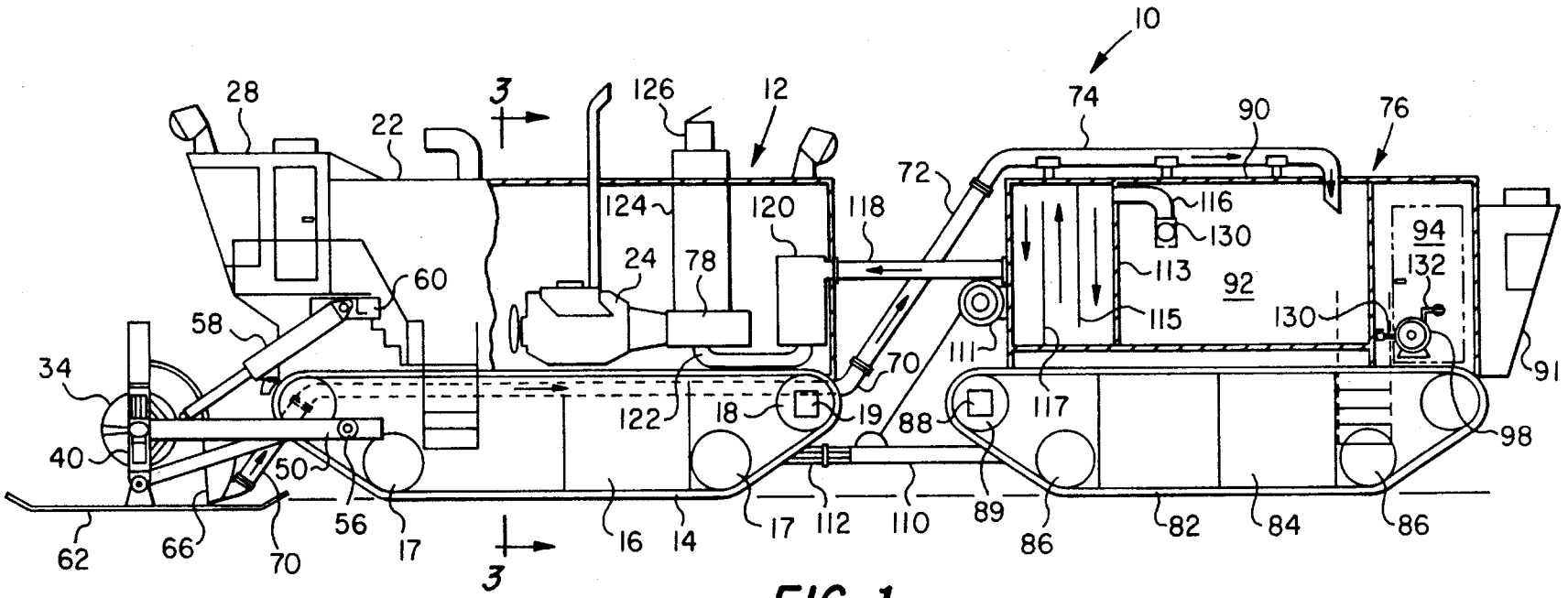
FIG. 1 is a longitudinal side elevation, partially sectioned, of the oil recovery vehicle system of the present invention.

In the description which follows, like parts are marked throughout the specification and drawing with the same reference numerals, respectively. The drawing figures are not necessarily to scale in the interest of clarity and conciseness.

Figure 3:
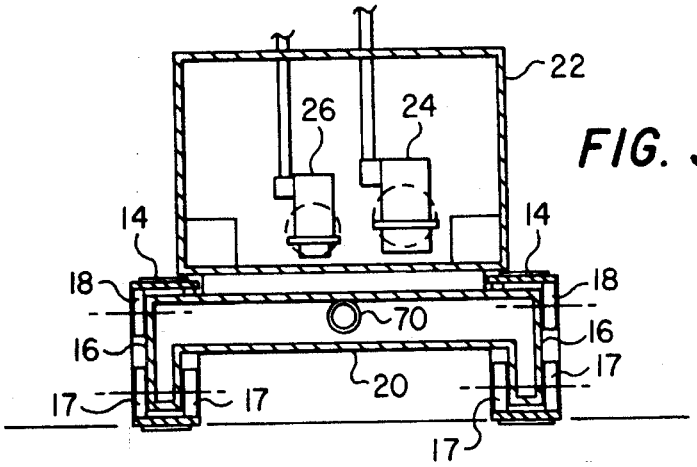
FIG. 3 is a section view taken generally along the line 3—3 of FIG. 1.

Referring to FIG. 1, there is illustrated a land vehicle system in accordance with the present invention and generally designated by the numeral 10. The vehicle system 10 includes a tractor and recovery unit 12 characterized by spaced apart endless crawler tracks 14, see FIGS. 3 and 4 also, which are suitably supported on opposed crawler frames 16 by conventional idler and drive wheel means 17 and 18. The crawler frames 16 are suitably interconnected by a transverse frame member 20, see FIG. 3. The combination of the spaced apart crawler frames 16 and the cross frame member 20 may be constructed as a substantially fluid-tight hollow box to serve as a flotation means or a "hull" for the vehicle unit 12. Accordingly, the system 10 may be operated on frozen bodies of water without fear of sinking if the ice surface should fail. The frame member 20 suitably supports a body 22 forming an enclosure for suitable prime movers 24 and 26, see FIGS. 3 and 4. An operator's cab 28 is located forward of the body 22 for operation of the tractor unit 12 as will be explained in further detail herein.

Figure 5:
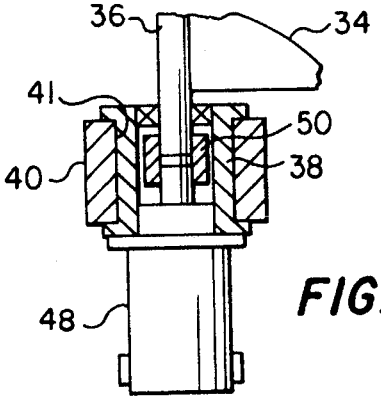
FIG. 5 is a detail section view taken from the line 5—5 of FIG. 2.
Figure 4:
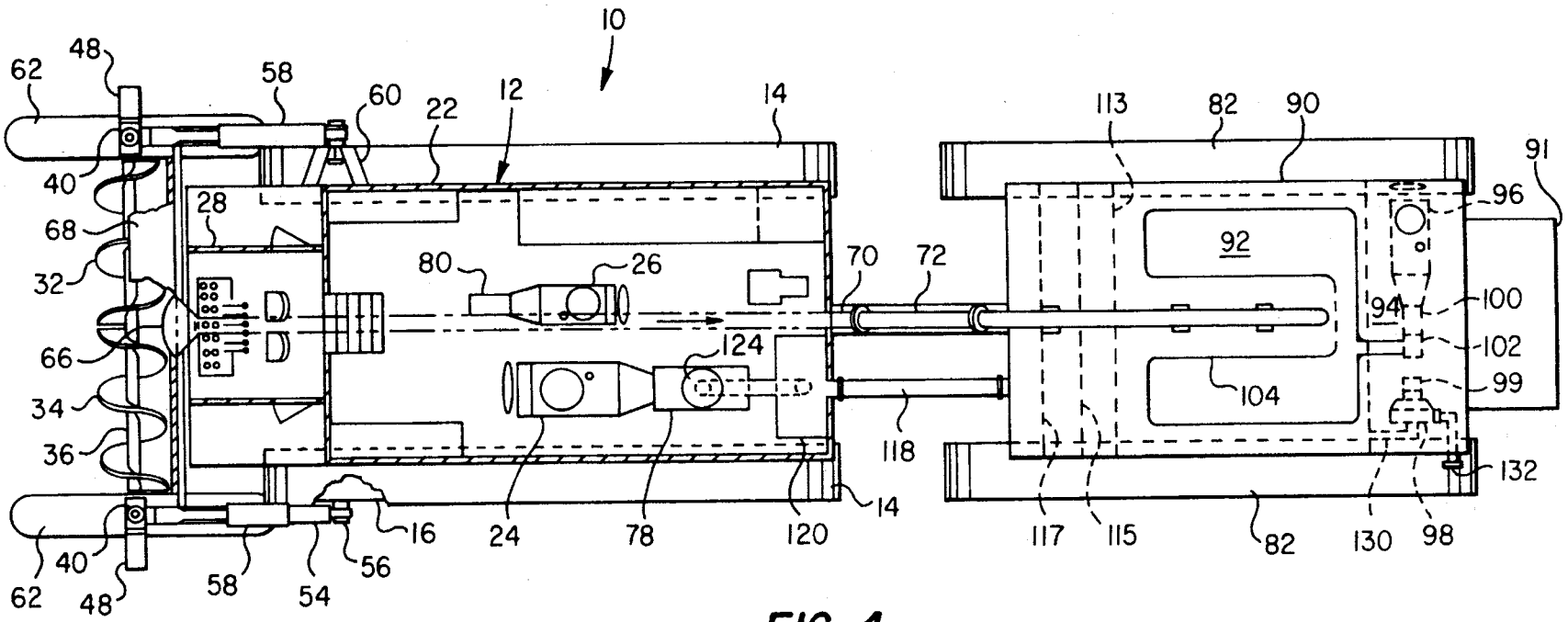
FIG. 4 is a plan view of the vehicle system illustrated in FIG. 1 partially sectioned.

Disposed forward of the tractor unit 12 and connected thereto is a transverse mounted surface skimming and transfer apparatus comprising a pair of opposed auger flights 32 and 34, see FIG. 4. The auger flights 32 and 34 are mounted on a suitable rotatable shaft 36 which is supported at its opposite ends in opposed support members 38, see FIGS. 2 and 5, which are each slidably journalled in an upstanding support member 40 for substantially vertical movement relative thereto. The support members 40 each have an elongated slot 41, see the example in FIG. 5, formed therein for slidably supporting the members 38 therein. Each of the members 38 is suitably connected to the piston rod 44 of a hydraulic positioning cylinder 46 mounted on the support member 40. Rotary hydraulic motors 48 are drivably connected to opposite ends of the shaft 36, as shown by example in FIG. 5, through suitable couplings 50.

Figure 2:
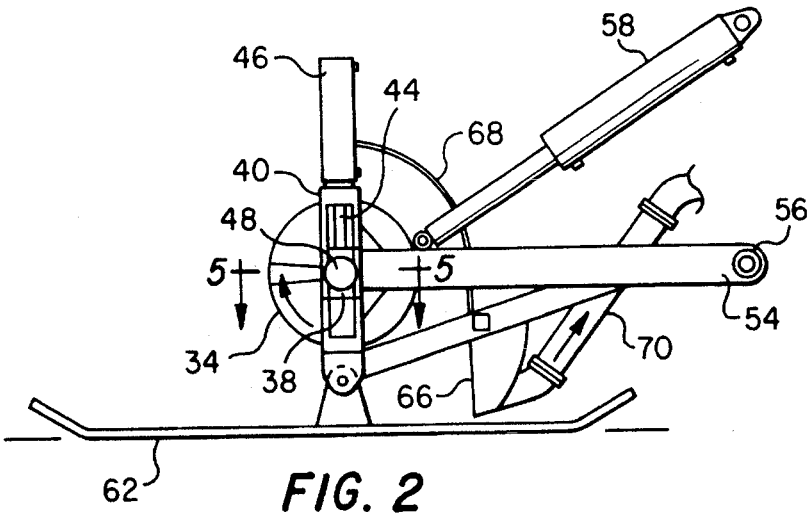
FIG. 2 is a detail view of the auger skimming and transfer mechanism.

Each of the support members 40 is suitably connected to an elongated support arm 54. The support arms 54 are, respectively, pivotally connected to the opposed track frames 16 at pivot means 56, FIGS. 1 and 2. The support arms 54 are each operably connected to a hydraulic cylinder type actuator 58. The actuators 58 are, respectively, supported by a suitable bracket 60 mounted on the body 22. The actuators 58 are operable to raise and lower the support arms 50 about their respective pivots 56. As shown in FIGS. 1, 2 and 4, spaced apart skis or skids 62 are pivotally connected to the support members 40 at an end of the support member opposite the actuator 46.

FIGS. 2 and 4 also illustrate a collector duct 66 centrally mounted on the tractor unit 12 just above the skis 62 and centrally of the opposed auger flights 32 and 34 for receiving oil covered snow and ice which has been transferred by the auger flights 32 and 34 to the center of the auger type skimming and transfer apparatus mounted on the tractor unit. A suitable curved shroud 68 extends above the collector duct 66 and coextensive with the auger flights 32 and 34. The collector duct 66 is connected to a transfer conduit 70 which extends longitudinally beneath the tractor body 22 from one end of the tractor unit 12 to the other. The conduit 70 is suitably connected to a flexible conduit section 72 which, in turn, is connected to a further conduit 74 supported on a second section of the vehicle system 10 comprising a storage and transport unit 76.

Accordingly, the oil covered snow and ice skimming or collection and transfer mechanism comprising the auger flights 32, 34 and the associated support structure may be remotely operated from the cab 28 by control of the hydraulic motors 48 to rotate the auger flights in the direction of the arrow indicated in FIGS. 1 and 2 and to vertically position the auger flights by operation of the actuators 46 with respect to the surface of the ice and snow cover which is contaminated by oil and/or other contaminants. Moreover, the position of the support arms 54 may also be adjusted by operation of the actuators 58 to raise or lower the entire collection and transfer apparatus represented by the auger flights 32, 34, the associated drive motors, the support members 38 and the actuators 46.

The prime movers 24 and 26 of the tractor unit 12 are operable to be drivably connected to a vacuum pump 78, FIGS. 1 and 4, and hydraulic pump means 80, respectively. Accordingly, the prime mover 26, which may comprise an internal combustion engine, is adapted to supply hydraulic fluid to operate traction motors 19 connected to the drive wheels 18, the auger drive motors 48 and the actuators 46 and 58, for example, as well as certain additional ancillary drive means, not shown, required for operation of the tractor unit 12. Operation of the tractor unit 12 may be carried out from the cab 28 by two operators, for example, one controlling the operation of the traction motors 19, including steering of the tractor unit, and the other operator controlling the operation of the skimming and transfer apparatus comprising the auger flights 32 and 34 and the associated support structure therefor. Still further, suitable controls may be located in the cab 28 for operation of the prime movers 24 and 26 and monitoring the performance thereof.

Referring further to FIGS. 1 and 4, in particular, the storage and transport unit 76 is also characterized by a set of spaced-apart endless crawler tracks 82 suitably mounted on track frames 84 similar to the track frames 16 and including suitable idler wheels 86 and traction motors 88 drivably connected to the tracks 84 via drive wheels 89 in a conventional manner. The frames 84 support a generally rectangular box-like body 90 forming a storage tank 92 and an engine room 94 in which is disposed a prime mover 96 and suitable pump means 98, see FIG. 4. The prime mover 96 may comprise an internal combustion engine operable to drive a hydraulic pump 100 and an electrical generator 102 for supplying electric power to a resistance type heating element 104 disposed in the tank 92 for melting snow and ice discharged into the tank by way of the conduit 74. The unit 76 may be propelled by hydraulic power applied to the traction motors 88 and a suitable motor 99 is operably connected to the pump 98 for driving same and may be either electrical or hydraulic and receiving power from the prime mover 96 by way of the pump 100 or the generator 102. The storage and transport unit 76 also includes an operator's cab 91 for operating the unit under its own power when it is uncoupled from the tractor unit 12. Still further the unit 76 may provide motive power to the system 10 when coupled to the unit 12. The unit 76 is suitably connected to the tractor unit 12 by a tow bar 110 and suitable hitch means 112. A cable winch 111 is operably connected to the tow bar 110 to assist in connection and disconnection of the unit 76 with respect to the unit 12.

The storage and transport unit 76 is also provided with a suitable air-liquid separator means characterized by a partition 113, FIG. 1, and plural spaced apart baffles 115 and 117 defining a flow path for fluid to flow from the tank 92 through an inlet conduit 116 leading to the separator means and a discharge conduit 118 inter-connecting the unit 76 with an inlet plenum 120 operably connected to the pump 78 by way of a conduit 122. A discharge silencer and separator 124 is also operably connected to the pump 78 for discharging air back to atmosphere through a stack 126. The conduit 118 is preferably a flexible pipe or tube and is provided with suitable quick disconnect couplings at one end or the other as is the conduit 72 so that the unit 76 may be disconnected from the tractor unit 12 and, under its own power, traversed to a suitable storage area for discharging a quantity of oil and melted snow and ice from the storage tank 92. In this regard, the pump 98 has a suitable inlet conduit 130 in communication with the tank 92 and a discharge conduit 132 adapted for connection to a suitable storage tank, not shown, for off-loading the tank 92.

In operation, the vehicle system 10 is usually operated with the tractor unit 12 towing the storage and transport 76 and with the conduits 72 and 118 suitably connected between the units for operation to transport oil or other contaminants removed from a snow and ice surface through the conduit 70 to the conduit 74 and the tank 92. Contaminated snow and/or ice conveyed by air separates substantially therefrom in the tank 92 and residual airborne material is further separated in the separator means formed by the baffles 115 and 117 whereby substantially liquid free air flows through the conduit 118, plenum 120 and the pump 78.

Substantial separation of air from liquid or particulate snow and ice is accomplished in the tank 92 and in the separator defined by the baffles 115 and 117. The plenum 120 and/or the separator 124 also operate to separate fine or atomized particles from the air flowstream. A suitable float valve closure 130 is interposed in the conduit 116 to prevent flow of snow and ice into the separator defined by the baffles 115, 117 when the level of material in the tank reaches a predetermined point. The accumulation of snow and ice and crude oil, for example, in the tank 92 is melted and maintained at a flowable temperature by the heating element 104 during operation of the system 10. Moreover, as the vehicle system 10 traverses snow and ice surfaces which have been contaminated by spillage of crude oil or other contaminants, the auger type collection and transfer means is suitably set at a level which will skim all of the contaminant from the snow and ice surface upon rotation of the auger flights 32, 34 and operation of the pump 78 to ingest oil contaminated snow and/or ice through the collector duct 66, the conduits 70, 72, 74 to the storage tank 92. The height of the auger flights 32, 34 may be continuously adjusted by one of the operators in the cab 28 through actuation of the actuators 46 and 58 and the speed of rotation of the auger 32, 34 may be controlled by the motors 48.

When the tank 92 reaches a level which requires emptying, the unit 76 may be uncoupled from the tractor unit 12 and quick disconnect couplings, not shown, in the conduits 72 and 118 may be operated to disconnect these conduits from the conduit 70 and/or 74 and from the separator defined by the baffles 115, 117 with respect to the plenum 120. When the unit 76 has been uncoupled from the tractor unit 12 it may, under its own power, be traversed to a point where the contents of the tank 92 may be discharged through operation of the pump 98. By providing a plurality of units 76 in proximity to the spill or contaminated area, once a storage and transport unit has its tank loaded with contaminated snow and/or ice, it may be disconnected from the tractor unit 12 and a unit with an empty tank 92 may be suitably connected to the tractor unit 12 in the manner illustrated to provide for substantially continuous operation of the system 10.

The tractor unit 12 and the storage and transport unit 76 may be constructed using conventional materials and components known to those of skill in the art of track type vehicles developed for transport and construction activity in arctic climates. The auger flights 32 and 34 may require suitable teeth or chipping elements, not shown, formed on the periphery of the auger blades to facilitate removal of ice, in particular.

Although a preferred embodiment of a system for cleanup or recovery of oil and other contaminants on snow and ice surfaces has been described in detail herein, those skilled in the art will recognize that various substitutions and modifications may be made to the system and its components without departing from the scope and spirit of the invention as recited in the appended claims.

What is claimed is:

1. A vehicle system for recovering oil and similar contaminants deposited on a snow or ice covered surface of the earth, comprising:

a. a tractor unit comprising:
   i. a propulsion system for traversing the tractor unit over the surface; and
   ii. spaced apart frames for supporting endless crawler tracks thereon, respectively, the frames comprising hollow boxes forming flotation chambers for buoyantly supporting the tractor unit in water;

b. a collection and transfer system mounted on the tractor unit for skimming the contaminant, including some snow or ice, off of the surface;

c. a storage and transport unit removably connected to the tractor unit, and including a storage tank for receiving the contaminant and a certain amount of snow and ice collected by the collection and transfer system; and d. a conduit system removably connected to both the tractor unit and the storage and transport unit, for conducting a mixture of the contaminant and snow or ice collected by the collection and transfer system to the storage and transport unit.

2. A vehicle system for recovering oil and similar contaminants deposited on a snow or ice covered surface of the earth, comprising:

a. a tractor unit comprising a first propulsion system for traversing the tractor unit over the surface;

b. a collection and transfer system mounted on the tractor unit for skimming the contaminant, including some snow or ice, off of the surface;

c. a storage and transport unit removably connected to the tractor unit, the storage and transport unit comprising:
   i. a storage tank for receiving the contaminant and a certain amount of snow and ice collected by the collection and transfer system; and
   ii. a second, self-contained propulsion system for traversing the storage and transport unit over the surface; and d. a conduit system removably connected to both the tractor unit and the storage and transport unit, for conducting a mixture of the contaminant and snow or ice collected by the collection and transfer system to the storage and transport unit.

3. The vehicle system of claim 2 further comprising an operator's cab mounted on the storage and transport unit.

4. The vehicle system of claim 2 wherein the second propulsion system is adapted for traversing both the storage and transport unit and the tractor unit over the surface.

5. A vehicle system for recovering oil and similar contaminants deposited on a snow or ice covered surface of the earth, comprising:

a. a tractor unit comprising a propulsion system for traversing the tractor unit over the surface, and spaced apart frames for supporting endless crawler tracks therein, respectively, the frames comprising hollow boxes forming floatation chambers for buoyantly supporting the tractor unit in water;

b. a collection and transfer system mounted on the tractor unit for skimming the contaminant, including some snow or ice, off of the surface;

c. a storage and transport unit removably connected to the tractor unit, the storage and transport unit comprising:
   i. a storage tank for receiving the contaminant and a certain amount of snow and ice collected by the collection and transfer system; and
   ii. a discharge pump connected to the storage tank; and d. a conduit system removably connected to both the tractor unit and the storage and transport unit, for conducting a mixture of the contaminant and snow or ice collected by the collection and transfer system to the storage and transport unit.

6. The vehicle system of either claims 2 or 5, further comprising a cable winch mounted on the storage and transport unit.

7. The vehicle system of either claims 2 or 5, wherein the conduit system is connected to both the tractor unit and the storage and transport unit with quick disconnect couplings.

8. A vehicle system for recovering oil and similar contaminants deposited on a snow or ice covered surface of the earth, comprising:

a. a tractor unit comprising:
   i. a propulsion system for traversing the tractor unit over the surface; and
   ii. spaced apart flames for supporting endless crawler tracks thereon, respectively, the flames comprising hollow boxes forming flotation chambers for buoyantly supporting the tractor unit in water; and b. a collection and transfer system comprising a vacuum pump mounted on the tractor unit for skimming the contaminant, including some snow or ice, off of the surface;

c. a storage and transport unit removably connected to the tractor unit, comprising:
   i. a storage tank for receiving the contaminant and a certain amount of snow and ice collected by the collection and transfer system; and
   ii. an air-liquid separator in communication with the storage tank and the vacuum pump; and d. a conduit system removably connected to both the tractor unit and the storage and transport unit, for conducting a mixture of the contaminant and snow or ice collected by the collection and transfer system to the storage and transport unit.

9. A vehicle system for recovering oil and similar contaminants deposited on a snow or ice covered surface of the earth, comprising:

a. a tractor unit comprising a first propulsion system for traversing the tractor unit over the surface;

b. a collection and transfer system mounted on the tractor unit for skimming the contaminant, including some snow or ice, off of the surface;

c. a storage and transport unit removably connected to the tractor unit, the storage and transport unit comprising:

i. a storage tank for receiving the contaminant and a certain amount of snow and ice collected by the collection and transfer system;

ii. a second propulsion system for traversing the storage and transport unit over the surface; and iii. a discharge pump connected to the storage tank; and d. a conduit system removably connected to both the tractor unit and the storage and transport unit, for conducting a mixture of the contaminant and snow or ice collected by the collection and transfer system to the storage and transport unit.

10. The vehicle system of claim 9 further comprising:

a. an operator's cab mounted on the storage and transport unit; and b. a cable winch mounted on the storage and transport unit;

wherein the conduit system is connected to both the tractor unit and the storage and transport unit with quick disconnect couplings, and wherein the second propulsion system is adapted for traversing both the storage and transport unit and the tractor unit over the surface.

* * * * *